US007024134B2

(12) United States Patent
Yokomori et al.

(10) Patent No.: US 7,024,134 B2
(45) Date of Patent: Apr. 4, 2006

(54) RIGID PROCESS CARTRIDGE AND ELECTROPHOTOGRAPHIC IMAGE FORMING APPARATUS INCORPORATING THE SAME

(75) Inventors: Kanji Yokomori, Tokyo (JP); Shinjiro Toba, Tokyo (JP); Hideki Maeshima, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/889,631

(22) Filed: Jul. 12, 2004

(65) Prior Publication Data

US 2005/0019059 A1 Jan. 27, 2005

(30) Foreign Application Priority Data

Jul. 25, 2003 (JP) ..... 2003-201489

(51) Int. Cl.
*G03G 15/00* (2006.01)
*G03G 21/16* (2006.01)

(52) U.S. Cl. ..... 399/111; 399/123

(58) Field of Classification Search ..... 399/111
See application file for complete search history.

(56) References Cited

U.S. PATENT DOCUMENTS 6,253,044 B1 * 6/2001 Shoji et al. ..... 399/111

FOREIGN PATENT DOCUMENTS

| | | | |
|---|---|---|---|
| JP | 61230183 A | * | 10/1986 |
| JP | 08063063 A | * | 3/1996 |
| JP | 10161497 A | * | 6/1998 |
| JP | 10-301460 A | | 11/1998 |
| JP | 2000132040 A | * | 5/2000 |

* cited by examiner

*Primary Examiner*—Quana Grainger
(74) *Attorney, Agent, or Firm*—Canon U.S.A. Inc I.P. Div

(57) ABSTRACT

A process cartridge and an electrophotographic image forming apparatus incorporating the same. The process cartridge includes an electrophotographic photosensitive member, a container supplying a developer to the electrophotographic photosensitive member, a cleaning member including a blade and a support portion supporting the blade, the blade selectively contacting the electrophotographic photosensitive member to remove the developer from the electrophotographic photosensitive member, and a cartridge frame supporting the electrophotographic photosensitive member and the support portion, the cartridge frame including a contact portion contacting the support portion under external forces on the cartridge frame to prevent deformation of the cartridge frame.

15 Claims, 8 Drawing Sheets

RIGID PROCESS CARTRIDGE AND ELECTROPHOTOGRAPHIC IMAGE FORMING APPARATUS INCORPORATING THE SAME

BACKGROUND OF THE INVENTION

1. Field of the Invention

The present invention relates to an electrophotographic image forming apparatus and a process cartridge for use with the electrophotographic image forming apparatus.

2. Description of the Related Art

An electrophotographic image forming apparatus is an apparatus for forming an image onto a recording medium by an electrophotographic image forming system. Examples of such apparatuses include electrophotographic copying machines, electrophotographic printers (e.g., laser-beam printers, LED printers), facsimile machines, and word processors.

A process cartridge can include at least cleaning means and an electrophotographic photosensitive drum, and can be detachably mounted to the body of the image forming apparatus.

Conventional electrophotographic image forming apparatuses using an electrophotographic image forming process adopt a process cartridge system in which an electrophotographic photosensitive member and process means for the electrophotographic photosensitive member are integrated in a cartridge, which can be detachably mounted to an image forming apparatus body. With such process cartridge system, users can themselves maintain the apparatus and do not require repair people, thus significantly improving ease of use. Such process cartridge system is widely used in image forming apparatuses.

Recently, multicolor-image forming apparatuses utilize a plurality of process cartridges of different colors. Providing the plurality of process cartridges detachable to the image forming apparatus body improves ease of use for users.

The multicolor-image forming apparatus can be personalized by vertically disposing a plurality of process cartridges to reduce its installation area in view of space saving.

The image forming apparatus with the above structure may have a flat process cartridge to reduce the height.

For this purpose, for example, a technique for cleaning means is disclosed in Japanese Patent Laid-Open No. 10-301460 in which waste toner, which is a transfer residual developer agent, is carried horizontally and a waste-toner storage chamber is formed in a flat shape.

With the above-described structure, the rigidity of the part where the waste-toner storage means is disposed becomes lessened. As such, when the user strongly grasps the process cartridge, the waste-toner storage chamber may be deformed.

SUMMARY OF THE INVENTION

The present invention is directed to a compact process cartridge configured such that, when a user grasps the process cartridge, a frame of the process cartridge is prevented from substantially deforming.

The present invention is directed to a compact process cartridge configured such that, when a user grasps the process cartridge, leakage of developer from the process cartridge is prevented.

The present invention is also directed to an electrophotographic image forming apparatus to which the process cartridge is detachably mounted.

In one aspect of the present invention, the process cartridge includes an electrophotographic photosensitive member, a cleaning member including a blade and a support portion supporting the blade, the blade contacting the electrophotographic photosensitive member to remove the developer from the electrophotographic photosensitive member, and a cartridge frame supporting the electrophotographic photosensitive member and the support portion, the cartridge frame including a contact portion contacting the support portion under an external force on the cartridge frame to prevent deformation of the cartridge frame.

In one embodiment, the contact portion includes a rib projecting from the frame to contact the support portion.

Further features and advantages of the present invention will become apparent from the following description of the embodiments with reference to the attached drawings.

DESCRIPTION OF THE PREFERRED EMBODIMENT

A developer unit, a process cartridge, and an image forming apparatus including the same according to an embodiment of the present invention will now be described.

[Overall Structure of Color-Image Forming Apparatus]

Figure 2:
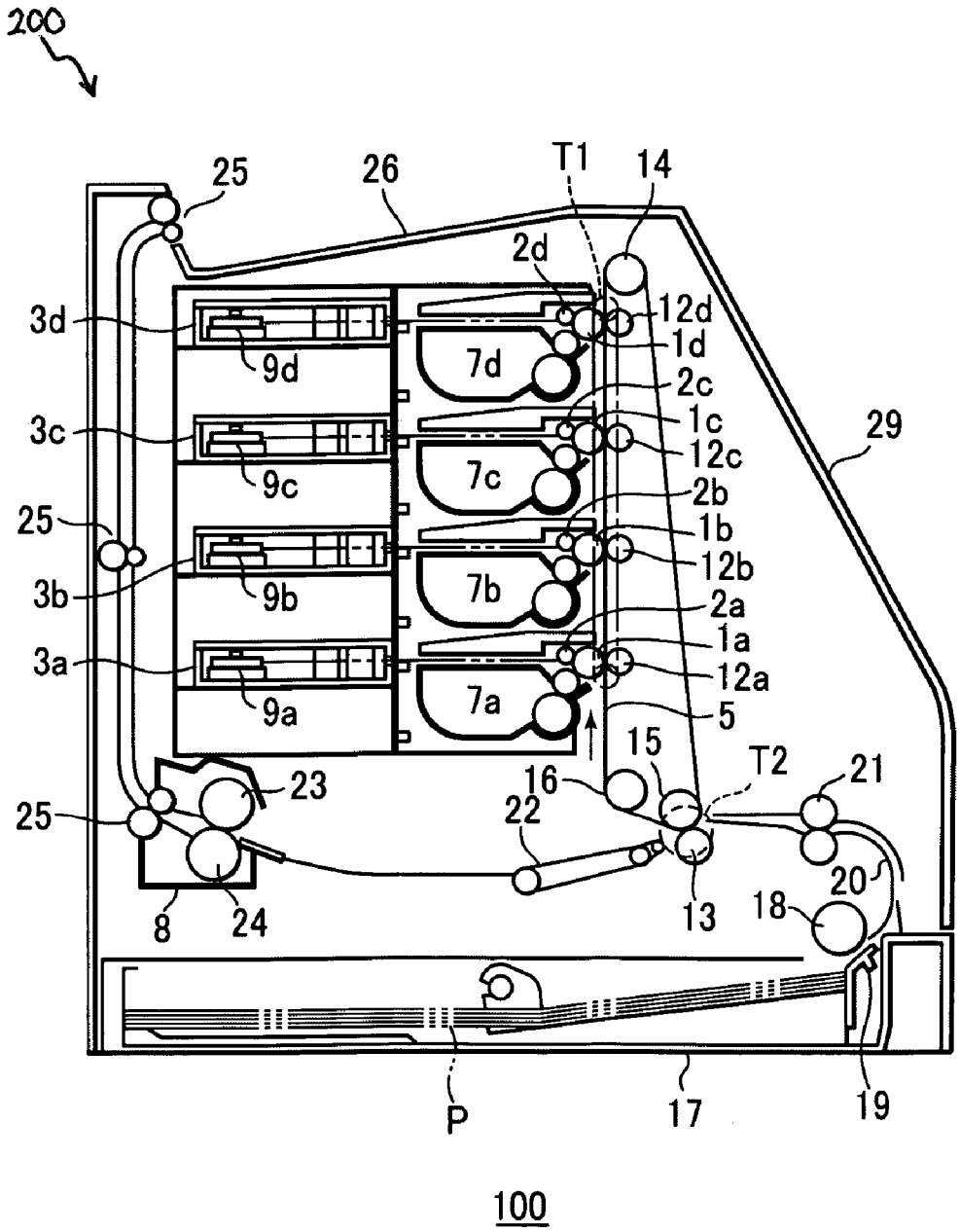
FIG. 2 is a schematic diagram of a color image-forming apparatus in accordance with one embodiment of the present invention.
Figure 3:
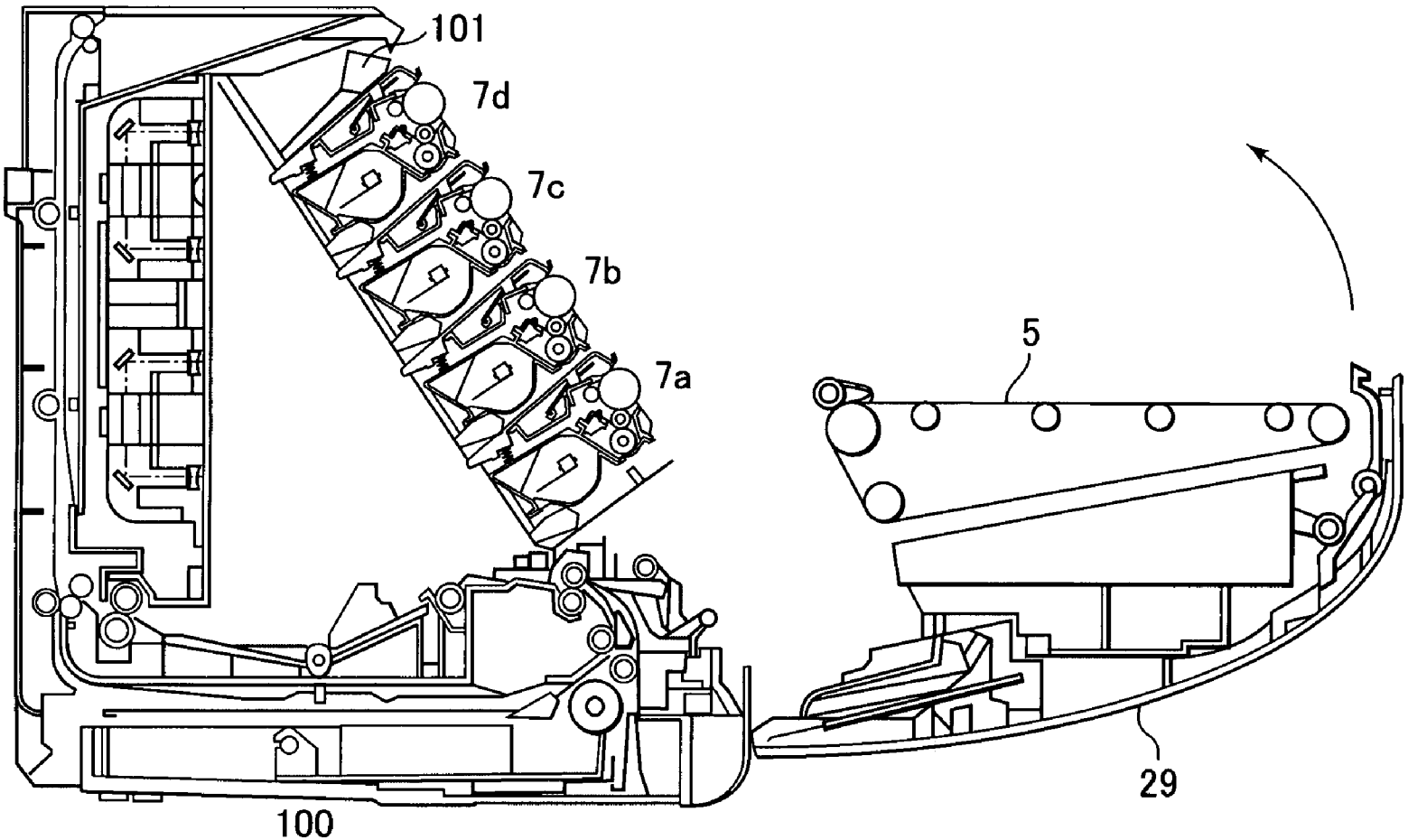
FIG. 3 is a schematic diagram of process cartridges used in the color image-forming apparatus shown in FIG. 2.

The overall structure of a color-image forming apparatus will be schematically described with reference to FIGS. 2 and 3. FIG. 2 is a schematic diagram of a color image-forming apparatus 200 in accordance with one embodiment of the present invention. The color image-forming apparatus 200 can be a color laser printer, for example. FIG. 3 is a schematic diagram of process cartridges 7 used in the color image-forming apparatus 200 shown in FIG. 2.

Referring to FIG. 2, the color laser printer 200 includes an image forming section having photosensitive drums 1*a*, 1*b*, 1*c*, and 1*d* (collectively referred to as photosensitive drum 1) for each of yellow, magenta, cyan, and black colors, respectively. The printer 200 also includes an intermediate transfer member 5 that holds a color image developed by the image forming section and transferred in multiple colors. The intermediate transfer member 5 transfers the color image to a recording medium (transfer material) P fed by feeding means. The photosensitive drums 1*a*, 1*b*, 1*c*, and 1*d* are rotated counterclockwise in the drawing by driving means (not shown). Around the photosensitive drum 1 is provided in the rotating direction charging means 2 (2*a*, 2*b*, 2*c*, and 2*d*) for uniformly charging the surface of the photosensitive drum 1 with electricity, a scanner unit 3 (3*a*, 3*b*, 3*c*, and 3*d*) for emitting a laser beam according to image information to form an electrostatic latent image on the photosensitive drum 1, a developer unit 4 (4*a*, 4*b*, 4*c*, and 4*d*) for applying toner, which is a developer agent, to the electrostatic latent image to develop it as a toner image, and a photoconductor unit 6 (6*a*, 6*b*, 6*c*, and 6*d*) for transferring the toner image on the photosensitive drum 1 to a primary transfer region T1 of the intermediate transfer member 5. The photoconductor unit 6 includes a cleaning unit for removing residual toner left on the surface of the photosensitive drum 1 after transfer. The toner image transferred to the intermediate transfer member 5 is further transferred onto the recording medium P with a transfer roller 13 at a transfer region T2. The recording medium P onto which the color image has been transferred is carried to fixing means 8, in which the color image is fixed to the recording medium P. The recording medium P is then discharged to an output tray 26 by discharge rollers 25.

The photosensitive drum 1, charging means 2, the developer unit 4, and the photoconductor unit 6 are integrated into a process cartridge 7.

Referring to FIG. 3, an image-forming apparatus body 100 includes an opening cover 29 integrated with the intermediate transfer member 5. The process cartridge 7 can be mounted to or dismounted from the image-forming apparatus body 100 when the opening cover 29 is opened and the photosensitive drum 1 set on this side.

The components of the image forming apparatus 200 will be specifically described hereinafter.

[Photosensitive Drum]

The photosensitive drum 1 will now be described in detail.

The photosensitive drum 1 includes an organic photoconductor (OPC) layer applied onto an outer surface of an aluminum cylinder with a diameter of, for example, 30 mm. The ends of the photosensitive drum 1 are rotatably supported by a supporting member (not shown). A drive motor (not shown) transmits a drive force to one or both ends of the drum 1 to drive the photosensitive drum 1 in a counter-clockwise direction, for example.

[Charging Means]

The charging means 2 employs a contact-roller electrifying system. The charging means 2 is a conductive roller that is brought into contact with the surface of the photosensitive drum 1 to uniformly charge the surface of the photosensitive drum 1 with electricity by applying charging bias to the charging means 2.

[Exposure Means]

The scanner unit 3 serving as exposure means emits an image light corresponding to an image signal to the polygon mirror 9 (9*a*, 9*b*, 9*c*, and 9*d*), which is rotated at a high speed by a scanner motor. The image light reflected by the polygon mirror 9 selectively exposes the surface of the photosensitive drum 1 rotating at a fixed speed with light through an imaging lens, thereby forming an electrostatic latent image onto the photosensitive drum 1.

[Developer Unit]

The developer unit 4 includes a toner container 41 that accommodates yellow, magenta, cyan, and black toners to visualize the electrostatic latent image. The toners in the toner container 41 are fed to a toner supply roller 43 with a toner mixing and feeding mechanism 42. The toner supply roller 43 rotates clockwise in the Z-direction and is in pressure contact with a developing roller 40. Electrically charged toner is applied to the outer surface of the developing roller 40, which is rotating clockwise (in the Y-direction), via a developing blade 44 and the toner supply roller 43.

A developing bias is applied to the developing roller 40 facing the photosensitive drum 1 on which an electrostatic latent image is formed, thereby developing the latent image.

[Intermediate Transfer Member]

The intermediate transfer member 5 rotates clockwise in synchronization with the outer speed of the photosensitive drum 1, as shown in FIG. 2. A primary transfer roller 12 (12*a*, 12*b*, 12*c*, and 12*d*) is disposed to face the photosensitive drum 1 with the intermediate transfer member 5 sandwiched therebetween. The toner image formed on the photosensitive drum 1 is transferred onto the intermediate transfer member 5 by application of voltage to the primary transfer roller 12. The intermediate transfer member 5, which receives the transferred image, then transfers the toner image onto the recording medium P via the transfer roller 13 having an applied voltage.

The intermediate transfer member 5 (intermediate transfer belt) according to the embodiment is stretched over a driving roller 14, a transfer opposing roller 15, and a tension roller 16.

The intermediate transfer member 5 is supported to the apparatus body 100 with the driving roller 14 as the fulcrum. The driving force of the drive motor (not shown) is transmitted to the intermediate transfer member 5 at one end of the driving roller 14 to rotate the intermediate transfer member 5 clockwise (in the direction of the arrow) with the image forming operation.

[Feeding Means]

The feeding means feeds the recording medium P to the image forming section. The feeding means includes a cassette 17, a feed roller 18, a separation pad 19, a guide 20, and a registration roller pair 21. During an image forming operation, the feed roller 18 rotates to feed the recording medium P in the cassette 17 one by one. The recording medium P is guided by the guide 20 and passes through the feed roller 18 to reach the registration roller pair 21. During the image forming operation, the registration roller pair 21 performs a stop operation to stop the recording medium P in standby mode, performs a rotating operation of feeding the recording medium P towards the intermediate transfer member 5 in a predetermined sequence, and also adjusts the transfer position of the image for transferring on the recording medium in the following process.

[Transfer Means]

A transfer means includes the movable transfer roller 13. The transfer roller 13 contacts the intermediate transfer member 5 with a specified pressure during transfer of a color image onto the recording medium P. At the same time, the transfer roller 13 is provided with a bias so that the toner image on the intermediate transfer member 5 is transferred onto the recording medium P. The recording medium P is transferred to the left at a specified speed during the transfer operation, towards the fixing means 8.

[Fixing Means]

The fixing means 8 fixes the toner image formed on the recording medium P. Specifically, the fixing means 8 includes a film guide unit 23 having a built-in ceramic heater for heating the recording medium P and a pressure roller 24 for bringing the recording medium P into pressure contact with the film guide unit 23.

[Image Forming Operation]

The operation of image formation with the apparatus constructed above will be described.

The feed roller 18, shown in FIG. 2, is rotated to separate one recording medium P in the cassette 17 and carry it to the registration roller pair 21.

The photosensitive drum 1 and the intermediate transfer member 5 are individually rotated in the direction of the arrow at a predetermined circumferential speed V (hereinafter, referred to as a process speed).

The surface of the photosensitive drum 1, which is uniformly electrified by the charging means 2, is exposed to laser light to form an image.

Latent-image formation, development, and toner transfer to the intermediate transfer member 5 are each performed in the respective primary transfer positions T1 in the order of yellow, magenta, cyan, and black, forming a full-color image made of four toners (yellow, magenta, cyan, and black colors) on the surface of the intermediate transfer member 5. The full-color image on the intermediate transfer member 5 is transferred onto the recording medium P with all the four colors at the same time. The recording medium P that has passed through the transfer region T2 is separated from the intermediate transfer member 5, carried to the fixing means 8, and discharged to the output tray 26 through the discharge rollers 25 after toner fixing operation. The image forming operation is thus finished.

[Structure of Process Cartridge]

Figure 4:
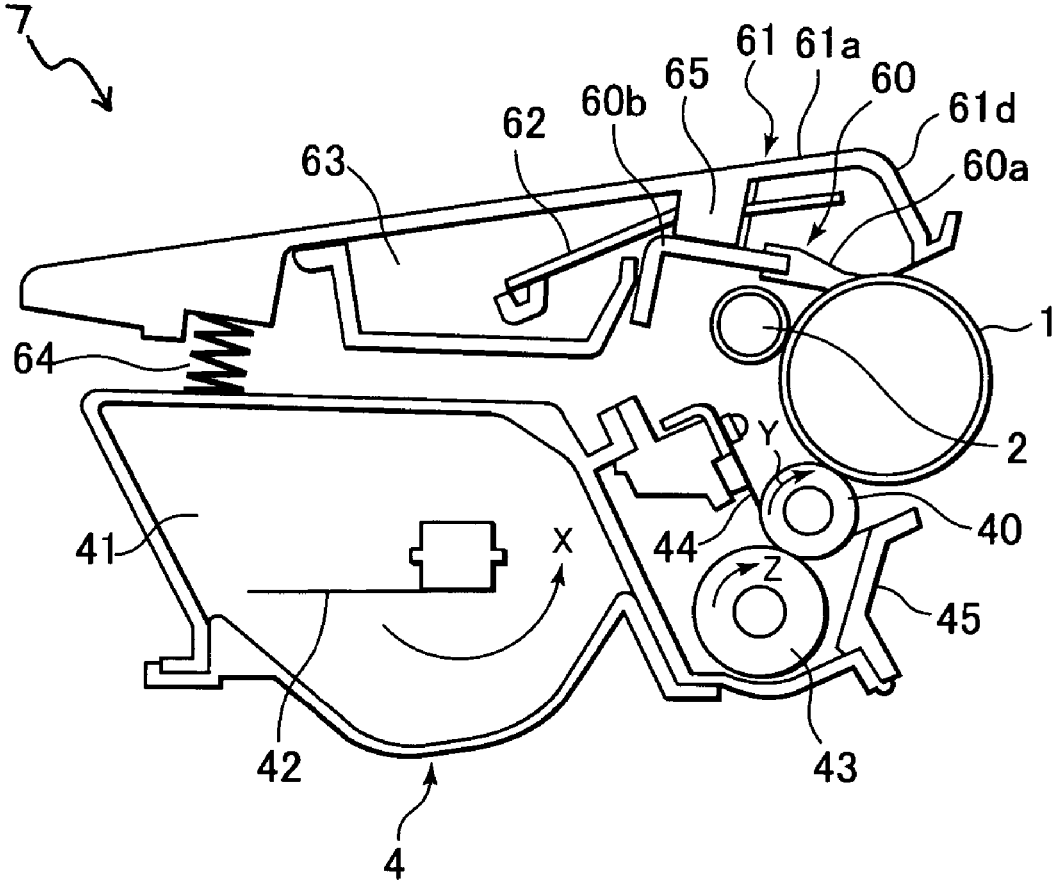
FIG. 4 is a cross-sectional view of the overall structure of a process cartridge.
Figure 5:
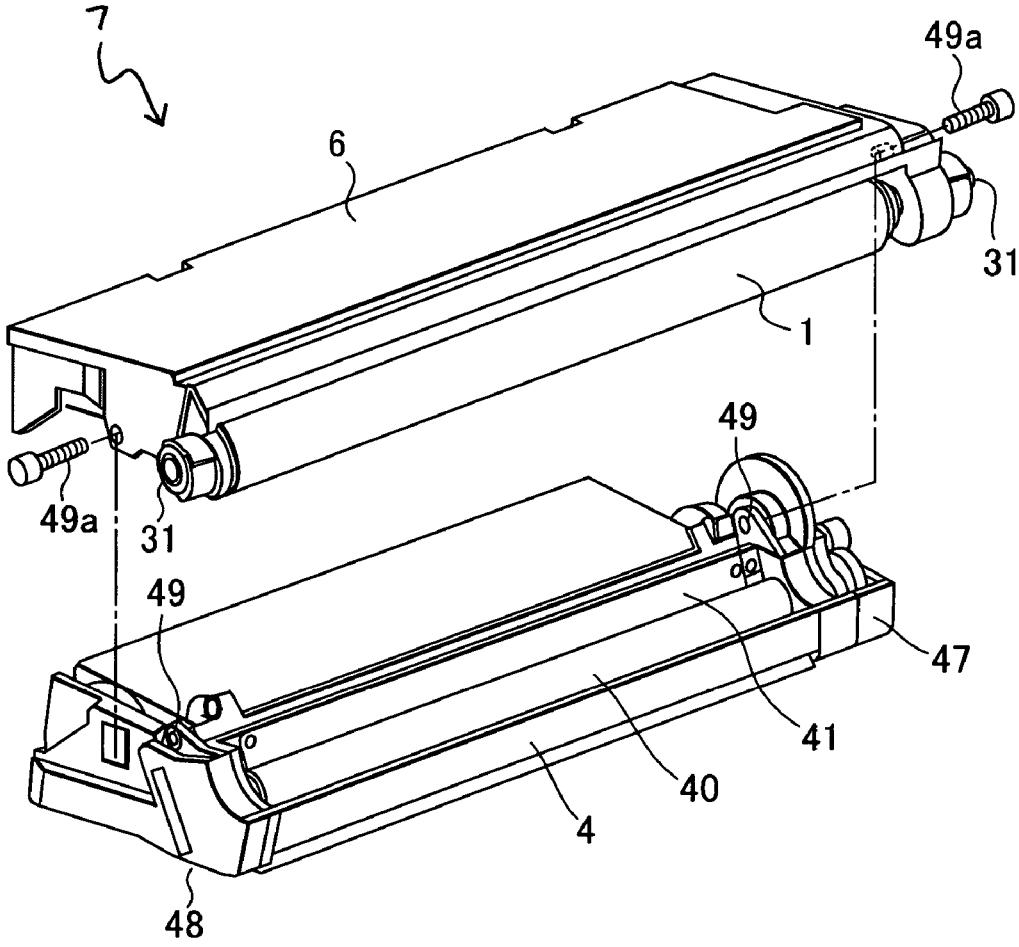
FIG. 5 is a perspective view of the structure of the process cartridge.
Figure 6:
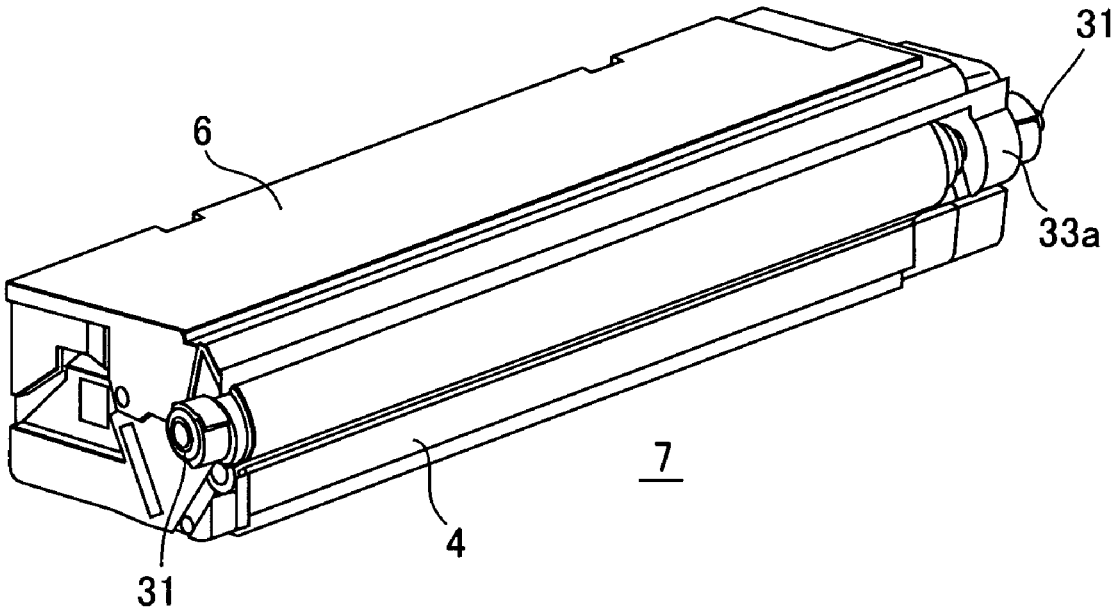
FIG. 6 is a perspective view of the process cartridge.

A process cartridge embodying the present invention will be specifically described with reference to FIGS. 4 and 5. FIG. 4 is a main cross-sectional view of the process cartridge 7 which accommodates toner. FIG. 5 is a perspective view of the process cartridge 7. FIG. 6 is a perspective view of the process cartridge. The respective process cartridges 7*a*, 7*b*, 7*c*, and 7*d* of yellow, magenta, cyan, and black colors have the same structure.

As shown in FIGS. 4 and 5, the process cartridge 7 is divided into the photoconductor unit 6 and the developer unit 4. The photoconductor unit 6 includes the photosensitive drum 1, the charging means 2, and a cleaning blade 60. The developer unit 4 includes the developing roller 40 for developing the electrostatic latent image on the photosensitive drum 1.

The photosensitive drum 1 of the photoconductor unit 6 is rotatably mounted to a cleaning frame 61 through a bearing member 31. Disposed around the outer surface of the photosensitive drum 1 is the charging means 2 for uniformly charging the surface of the photosensitive drum 1 with electricity and the cleaning blade 60 for removing the toner remaining on the photosensitive drum 1.

The blade 60 includes an elastic cleaning portion 60*a* that contacts the photosensitive drum 1, and a support plate 60*b* fixed to the cleaning frame 61 for supporting the cleaning portion 60*a*.

The material for the cleaning portion 60*a* can be an elastomer such as urethane and silicone, which is a urethane rubber with a hardness of 710 (Wallace) in this embodiment. The support plate 60*b* can be made of a rigid material, such as a cold rolled steel sheet of t=1.6.

If the contact pressure of the blade 60 on the photosensitive drum 1 is not uniform in the longitudinal direction, there may be incomplete cleaning which has significant effects on the image quality. As such, the blade 60 is accurately fixed to the cleaning frame 61.

The residual toner removed from the surface of the photosensitive drum 1 with the blade 60 is sequentially carried to a waste-toner chamber 63 provided at the rear of the cleaning frame 61 with a toner-carrying mechanism 62. The driving force of the drive motor (not shown) at one end of the rear is transmitted to the photosensitive drum 1 to rotate the photosensitive drum 1 counterclockwise during the image forming operation.

The developer unit 4 includes the developing roller 40 that contacts the photosensitive drum 1 and rotates in the direction of arrow Y. The developer unit 4 also includes the toner container 41 for accommodating toner, and a developer container 45. The developing roller 40 is rotatably supported by the developer container 45 with developer bearings 47 and 48. On the outer surface of the developing roller 40 is disposed the toner supply roller 43, which rotates in the direction of arrow Z, and the developing blade 44. The toner container 41 includes the toner mixing and feeding mechanism 42 therein for mixing the accommodated toners and carrying them to the toner supply roller 43.

As shown in FIG. 5, the developer unit 4 is provided with support holes 49 at the developer bearings 47 and 48. The developer unit 4 has a suspension structure rotatably supported to the photoconductor unit 6 with support pins 49*a* and the support holes 49.

Without the process cartridge 7 mounted to a printer body, the developer unit 4 is constantly biased by a pressure spring 64 so that the developing roller 40 is brought into contact with the photosensitive drum 1 around the support pins 49*a* (refer to FIG. 4).

During a developing operation, the accommodated toner is carried to the toner supply roller 43 via the toner mixing and feeding mechanism 42. The toner supply roller 43, which rotates in the direction of arrow Z, feeds the toner onto the developing roller 40 by sliding friction with the developing roller 40, which is rotating in the direction of arrow Y. The toner is thus supplied onto the developing roller 40. The toner on the developing roller 40 is moved to the developing blade 44 as the developing roller 40 rotates. The developing blade 44 applies an electrical charge to the toner to form them into a specified thin layer of toner. The toner is then carried to a developing section where the photosensitive drum 1 and the developing roller 40 are in contact with each other. The toner adhers to the electrostatic latent image formed on the surface of the photosensitive drum 1 by a direct-current developing bias applied from a power source (not shown) to the developing roller 40, thereby developing the latent image. Toner that does not contribute to the development and remains on the surface of the developing roller 40 is returned into the developer unit 4. As the developing roller 40 rotates, the toner is separated and collected from the developing roller 40 at the sliding frictional section with the toner supply roller 43. The collected toner is mixed with remaining toners by the toner mixing and feeding mechanism 42.

In the contact developing system for developing by the contact of the photosensitive drum 1 and the developing roller 40, the photosensitive drum 1 can be a rigid member and the developing roller 40 can be an elastic member. The elastic member includes a single solid-rubber layer and a resin coating on the solid rubber layer in view of a toner electrizing characteristic.

The toner supply roller 43 is an elastic roller made of a core metal and a sponge, of which the sponge is formed of continuously foamed sponge.

EMBODIMENTS OF THE INVENTION

The structure of an image forming apparatus according to the present invention and a process cartridge used therein will be specifically described with reference to FIGS. 1 to 4.

PRINCIPAL STRUCTURE OF THE INVENTION

Figure 1:
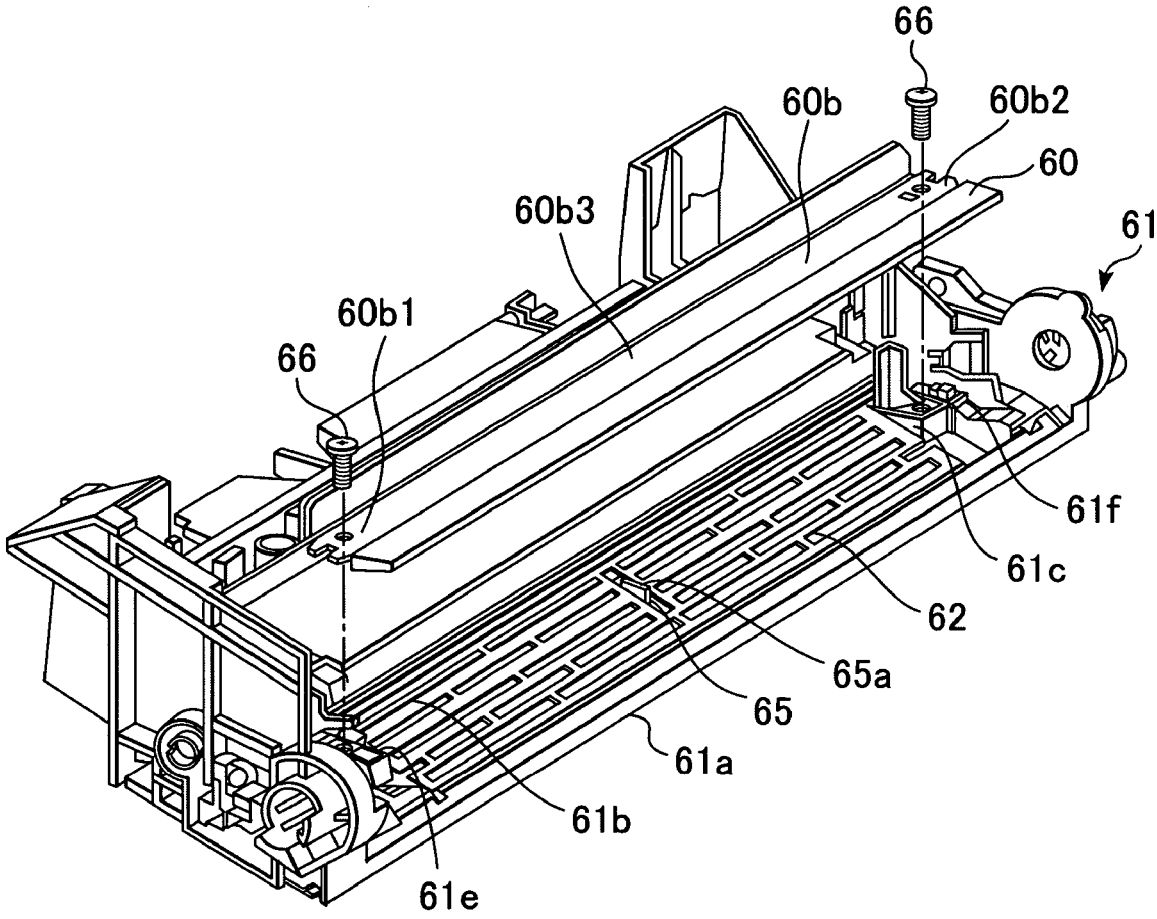
FIG. 1 is a perspective view of a cleaning unit according to an embodiment of the present invention.
Figure 7:
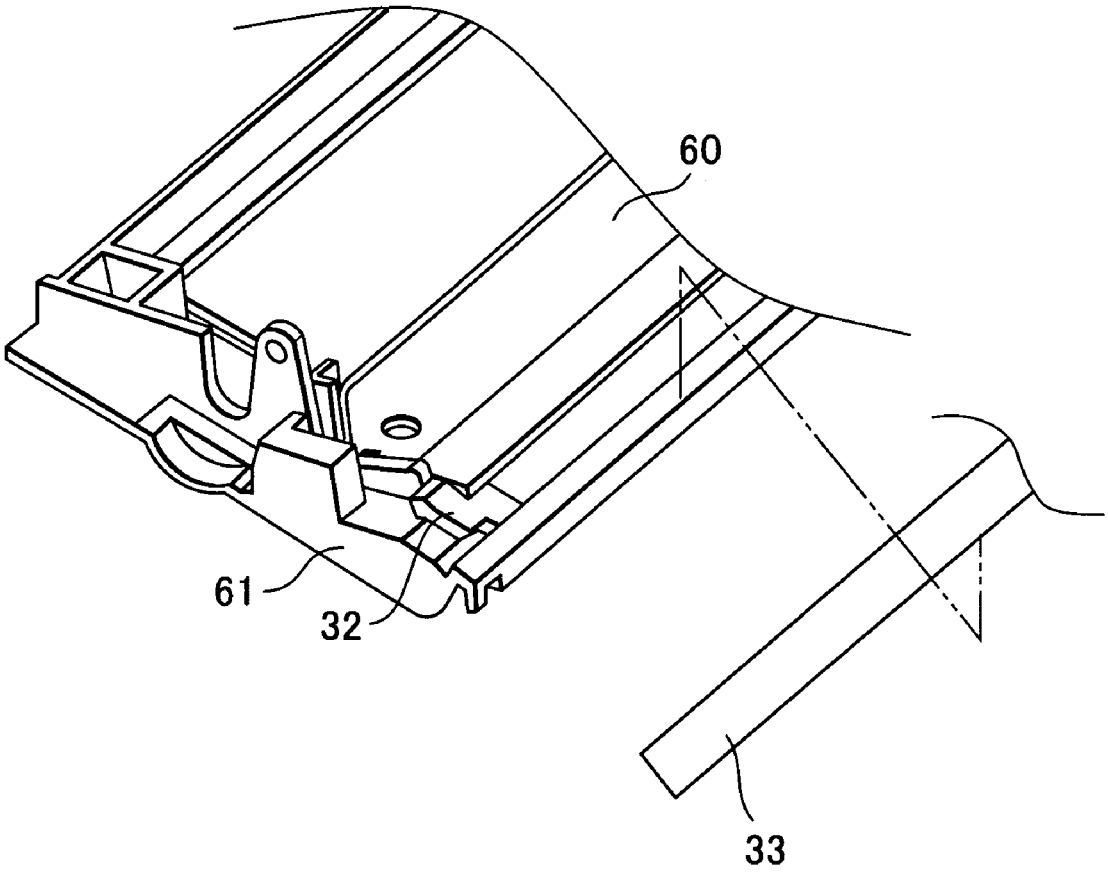
FIG. 7 is a partial perspective view of a cleaning unit according to the invention.
Figure 8:
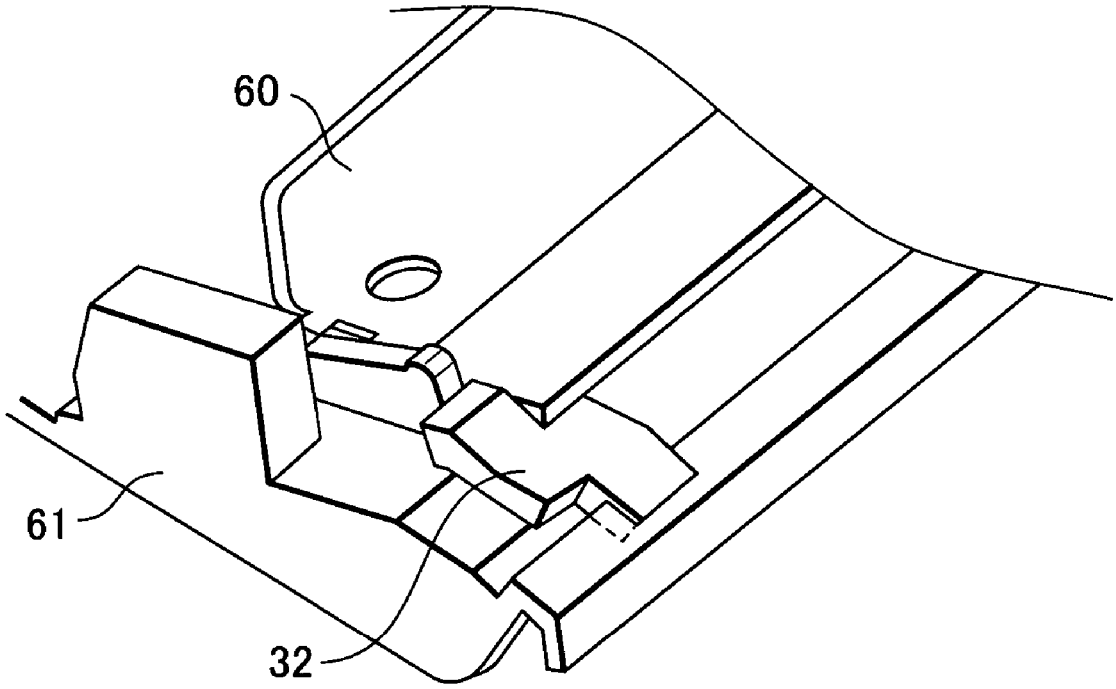
FIG. 8 is a perspective view showing the relationship between a cleaning frame and a sealing member according to the invention.

FIG. 1 is a perspective view of a cleaning unit according to an embodiment of the present invention. FIG. 7 is a partial perspective view of the cleaning unit according to the invention. FIG. 8 is a perspective view showing the relationship between a cleaning frame and a sealing member according to the invention. The cleaning frame 61 includes an upper plate 61*a*, opposite side plates 61*b* and 61*c*, a front wall 61*d*, and cleaning-blade support portions 61*e* and 61*f*. The waste-toner chamber 63 is provided at the rear of the cleaning frame 61.

Opposite ends 60*b*1 and 60*b*2 of the support plate 60*b* of the cleaning blade 60 are fixed to the opposite ends 61*e* and 61*f* of the cleaning frame 61 with fixing members such as screws 66. Thus, the cleaning blade 60 is in contact with the photosensitive drum 1 supported by the cleaning frame 61.

The upper plate 61*a* has a downward rib 65 at the center, which is a contact portion. The rib 65 has an end 65*a* which is adjacent to the center 60*b*3 of the cleaning-blade support plate 60*b*. The distance between the end 65*a* and the center 60*b*3 of the cleaning-blade support plate 60*b* is within the range of 0 to 1 mm, for example, which is set at 0.5 mm in this embodiment. This structure provides a support between the rigid metal plate and the upper plate 61*a* of the cleaning frame 61 even if a user strongly grasps the process cartridge vertically, thus eliminating the possibility of leakage of waste toner.

Also, a very small space is provided between the end of the rib 65 provided to the cleaning frame 61 and the cleaning-blade support plate 60*b*. This prevents application of a force that will deform the cleaning blade 60 during image forming operation, thus providing a preferable image.

As described above, according to the embodiment, even a compact flat process cartridge can have sufficient rigidity without causing leakage of waste toner.

In this embodiment, no undesired force is applied to the cleaning member during image formation, thus providing a preferable image.

As described above, according to the embodiment, a more compact process cartridge can be provided and the deformation of the cartridge frame can be prevented when it is grasped.

While the present invention has been described with reference to what are presently considered to be the embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A process cartridge for use in an electrophotographic image forming apparatus, the process cartridge comprising:

an electrophotographic photosensitive member;

a cleaning member including a blade and a support portion supporting the blade, the blade contacting the electrophotographic photosensitive member to remove a developer from the electrophotographic photosensitive member; and a cartridge frame supporting the electrophotographic photosensitive member and the support portion, the cartridge frame including a contact portion contacting the support portion under external forces on the cartridge frame to prevent deformation of the cartridge frame, wherein the contact portion contacts at about a center of the support portion, along the length of the cartridge frame.

2. A process cartridge according to claim 1, wherein the support portion is a metal plate disposed along a length of the cartridge frame.

3. A process cartridge according to claim 1, wherein the contact portion includes a rib projecting from the frame to contact the support portion.

4. A process cartridge according to claim 1, wherein an end of the support portion is fixed to the cartridge frame with a screw.

5. A process cartridge according to claim 1, further comprising:

a storage portion storing the developer removed by the blade;

a developing member developing an electrostatic latent image formed on the electrophotographic photosensitive member; and a container supplying the developer to the electrophotographic photosensitive member;

wherein the cartridge frame includes first and second frames, the first frame supporting the electrophotographic photosensitive member, the cleaning member, and the storage portion, and the second frame supporting the developing member and the container.

6. A process cartridge according to claim 5, wherein the first frame is oriented higher relative to the second frame when the process cartridge is mounted to the apparatus.

7. A process cartridge according to claim 5, wherein the cartridge frame is adapted for grasping by a user's hand.

8. A process cartridge for use in an electrophotographic image forming apparatus, the process cartridge comprising:

an electrophotographic photosensitive member;

a cleaning member including a blade and a support portion supporting the blade, the blade contacting the electrophotographic photosensitive member to remove a developer from the electrophotographic photosensitive member; and a cartridge frame supporting the electrophotographic photosensitive member and the support portion, the cartridge frame including a contact portion contacting the support portion under external forces on the cartridge frame to prevent deformation of the cartridge frame, wherein a clearance is provided between the contact portion and the support portion when no external forces arc applied to the cartridge frame.

9. A process cartridge according to claim 8, wherein the support portion is a metal plate disposed along a length of the cartridge frame.

10. A process cartridge according to claim 8, wherein an end of the support portion is fixed to the cartridge frame with a screw.

11. A process cartridge according to claim 8, further comprising:

a storage portion storing the developer removed by the blade;

a developing member developing an electrostatic latent image formed on the electrophotographic photosensitive member; and a container supplying the developer to the electrophotographic photosensitive member;

wherein the cartridge frame includes first and second frames, the first frame supporting the electrophotographic photosensitive member, the cleaning member, and the storage portion, and the second frame supporting the developing member and the container.

12. A process cartridge according to claim 11, wherein the first frame is oriented higher relative to the second frame when the process cartridge is mounted to the apparatus.

13. A process cartridge according to claim 11, wherein the cartridge frame is adapted for grasping by a user's hand.

14. An electrophotographic image forming apparatus for forming an image on a recording medium, the apparatus comprising:

(i) a detachable process cartridge comprising:

an electrophotographic photosensitive member;

a container supplying a developer to the electrophotographic photosensitive member;

a developing member developing an electrostatic latent image formed on the electrophotographic photosensitive member;

a cleaning member including a blade and a support portion supporting the blade, the blade selectively contacting the electrophotographic photosensitive member to remove the developer from the electrophotographic photosensitive member;

a cartridge frame supporting the electrophotographic photosensitive member and the support portion, the cartridge frame including a contact portion contacting the support portion under external forces on the cartridge frame to prevent deformation of the cartridge frame, wherein the contact portion includes a rib projecting from the frame to contact the support portion.

(ii) an intermediate transfer member receiving the developed electrostatic latent image from the electrophotographic photosensitive member and transferring the image onto the recording medium; and (iii) feeding means for feeding the recording medium to the intermediate transfer member.

15. An electrophotographic image forming apparatus according to claim 14, wherein the cartridge frame includes first and second frames, the first frame supporting the electrophotographic photosensitive member, the cleaning member, and the storage portion, and the second frame supporting the developing member arid the container.

* * * * *